US006591646B1

(12) United States Patent
Huang

(10) Patent No.: US 6,591,646 B1
(45) Date of Patent: Jul. 15, 2003

(54) STRUCTURE OF DECORATIVE HANGING HOOK

(76) Inventor: Chin-Lin Huang, 5, Kuang Cheng St., Panchiao 220, Taipei County (TW)

( * ) Notice: Subject to any disclaimer, the term of this patent is extended or adjusted under 35 U.S.C. 154(b) by 0 days.

(21) Appl. No.: 10/103,709

(22) Filed: Mar. 25, 2002

(51) Int. Cl.[7] ..... A47G 29/10

(52) U.S. Cl. ..... 70/456 R; 70/459; 24/3.6; 362/116

(58) Field of Search ..... 70/456 R, 459, 70/460, 454; 24/3.6; 206/38.1, 37.1, 37.4, 37.5, 37.6, 37.7, 37.8; 362/100, 116

(56) References Cited

U.S. PATENT DOCUMENTS

| | | | | | |
|---|---|---|---|---|---|
| 3,296,429 | A | * | 1/1967 | Schwartz | |
| 3,804,307 | A | * | 4/1974 | Johnston | 70/456 R X |
| 3,968,669 | A | * | 7/1976 | Coleman | 70/456 R |
| 4,282,733 | A | * | 8/1981 | Schmitt (Johnston) | 70/456 R |
| 4,376,383 | A | * | 3/1983 | Wolter | 70/456 R |
| 4,653,422 | A | * | 3/1987 | Allen | 70/456 R X |
| 4,831,504 | A | * | 5/1989 | Nishizawa et al. | 70/456 R X |
| 5,210,525 | A | * | 5/1993 | Lennon et al. | 70/456 R X |
| 5,318,177 | A | * | 6/1994 | Isacson | 206/38.1 |
| 5,540,367 | A | * | 7/1996 | Kauker | 224/269 |
| 5,685,185 | A | * | 11/1997 | MacDonald | 70/459 |
| 6,006,562 | A | * | 12/1999 | Wolter | 70/456 R |
| 6,079,845 | A | * | 6/2000 | Kreider | 362/116 |
| 6,158,875 | A | * | 12/2000 | Olivit et al. | 362/189 |
| 6,334,692 | B1 | * | 1/2002 | Hsueh | 362/116 |
| 6,351,903 | B1 | * | 3/2002 | Tuomi | 70/456 R X |
| 6,415,634 | B2 | * | 7/2002 | Luquire | 70/18 |
| 6,427,293 | B1 | * | 8/2002 | Bowes, Jr. | 24/304 |
| 6,471,064 | B2 | * | 10/2002 | Gordon | 206/534 |

FOREIGN PATENT DOCUMENTS

| | | | | |
|---|---|---|---|---|
| FR | 2259559 | * | 8/1975 | 70/456 R |
| FR | 2262178 | * | 9/1975 | 70/456 R |

* cited by examiner

*Primary Examiner*—Lloyd A. Gall
(74) *Attorney, Agent, or Firm*—Bacon & Thomas, PLLC

(57) ABSTRACT

A structure of a decorative hanging hook having a main body which is a connector with a light emitting member therein, wherein, the connector has on both ends thereof a hole for connecting respectively with a mountaineer carabine hook and an annular ring. Thereby, the entire decorative hanging hook can be directly hung on a backpack or a hanging loop on clothes or trousers with the annular ring thereof having keys or other ornaments. Above all, when being necessary, the light emitting diode on the light emitting member can be lightened by pressing a cover to provide a suitable effect of illumination.

4 Claims, 3 Drawing Sheets

STRUCTURE OF DECORATIVE HANGING HOOK

BACKGROUND OF THE INVENTION

1. Field of the Invention

The present invention is related to a structure of a decorative hanging hook, and especially to such a structure convenient for hanging on a backpack or a hanging loop of clothes or trousers, it can provide a decoration function, and can render a user to feel convenient for handling the decorative hanging hook, the decorative hanging hook can provide a suitable auxiliary illumination function when being necessary.

2. Description of the Prior Art

In the society nowadays in which information as well as propagation media extremely prevail, young people have braveness and capability to adequately show themselves not only in elementary costume style, but also in hanging ornaments to enhance presentation of their own styles. Particularly, they expect to make outstanding that they are on the top of the prevailing fashion by means of articles providing larger function.

Therefore, there have been multiple decorative hanging structures, these decorative hanging structures mostly are of the structural styles each with a key ring connecting therewith, in which, the key ring is connected with an ornament and keys. The annular rings thereof are further used to hang the entire decorative hanging structures on hanging loops on backpacks, clothes or trousers; thereby, the entire decorative hanging structures have better decorative functions. However, by virtue that the decorative hanging structures are hung on the hanging loops on backpacks, clothes or trousers, when a user wants to take a key for use, it needs quite a long time to remove the hanging loop from an annular ring to take off its decorative hanging structure, this makes difficulty in using, and more, other things may drop from the annular ring during removing the hanging loop.

SUMMARY OF THE INVENTION

Thereby, the structure of a decorative hanging hook of the present invention has a main body which is a connector with a light emitting member therein, the connector has on both ends thereof a hole for connecting respectively with a mountaineer carabine hook and an annular ring. Thereby, the entire decorative hanging hook can be directly hung on a backpack or a hanging loop on clothes or trousers with the annular ring thereof having keys or other ornaments. Above all, when being necessary, the light emitting diode on the light emitting member can be lightened by pressing a cover to provide illumination, and this is the main object of the present invention.

The present invention will be apparent after reading the detailed description of the preferred embodiment thereof in reference to the accompanying drawings.

DETAILED DESCRIPTION OF THE PREFERRED EMBODIMENT

Figure 1:
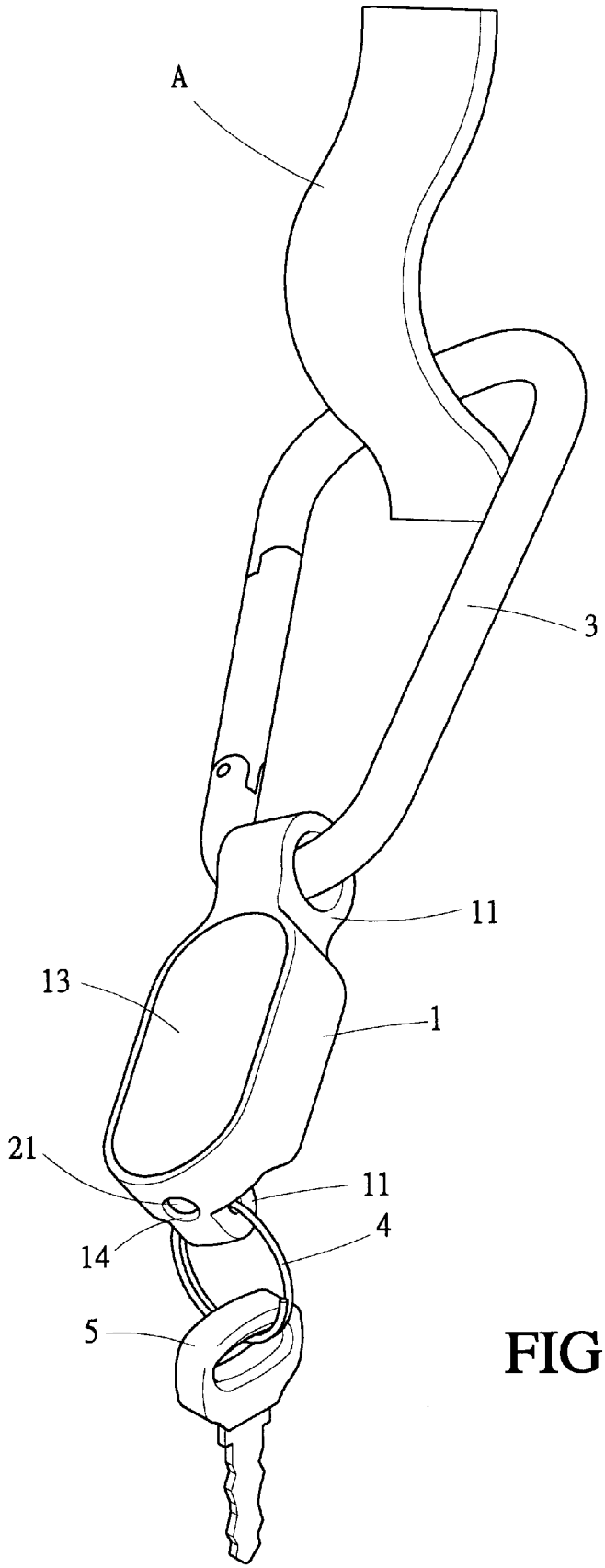
FIG. 1 is a perspective view showing the appearance of the preferred embodiment of the structure of a decorative hanging hook of the present invention.
Figure 2:
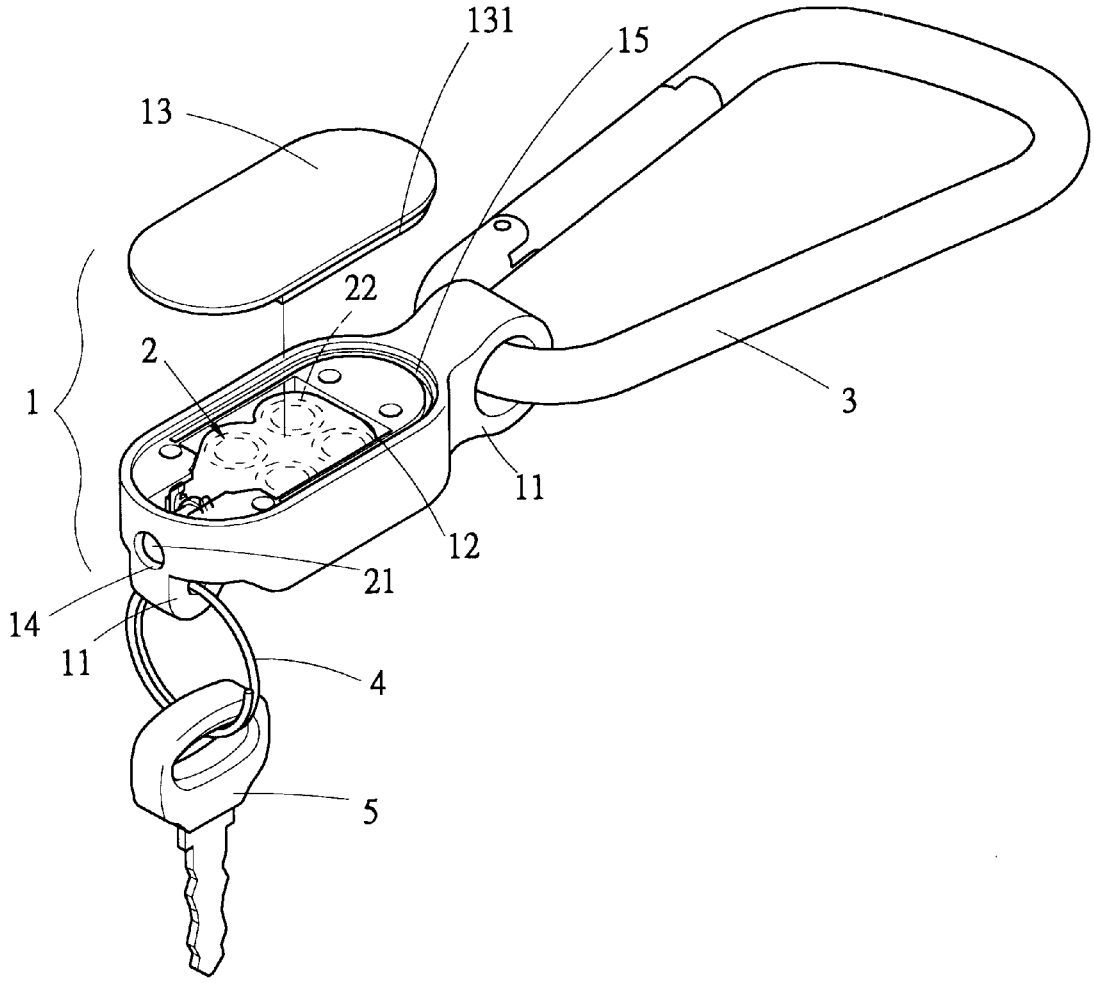
FIG. 2 is an analytic perspective view showing the structure of a connector of the decorative hanging hook of the present invention.

The structure of the decorative hanging hook of the present invention is composed in the way as shown in FIGS. 1 and 2, it is comprised mainly of: a connector 1 being the main body of the entire decorative hanging hook, in which two holes 11 are provided respectively on the two ends of the connector 1, a receiving chamber 12 is provided in the main body, a pressing-closed cover 13 is used to close the receiving chamber 12; a carabine hook 3 extending into the hole 11 on one end of the connector 1; an annular ring 4 extending into the other hole 11 on another end of the connector 1; a light emitting member 2 provided in the receiving chamber 12 of the connector 1 and comprising a light emitting diode 21 and a battery 22 for activating the light emitting diode 21 for lightening.

Wherein, the connector 1 is made of plastic material having suitable tenacity, the main body is provided on one end thereof with a light getting-through hole 14 for projecting light of the light emitting diode 21.

Figure 3:
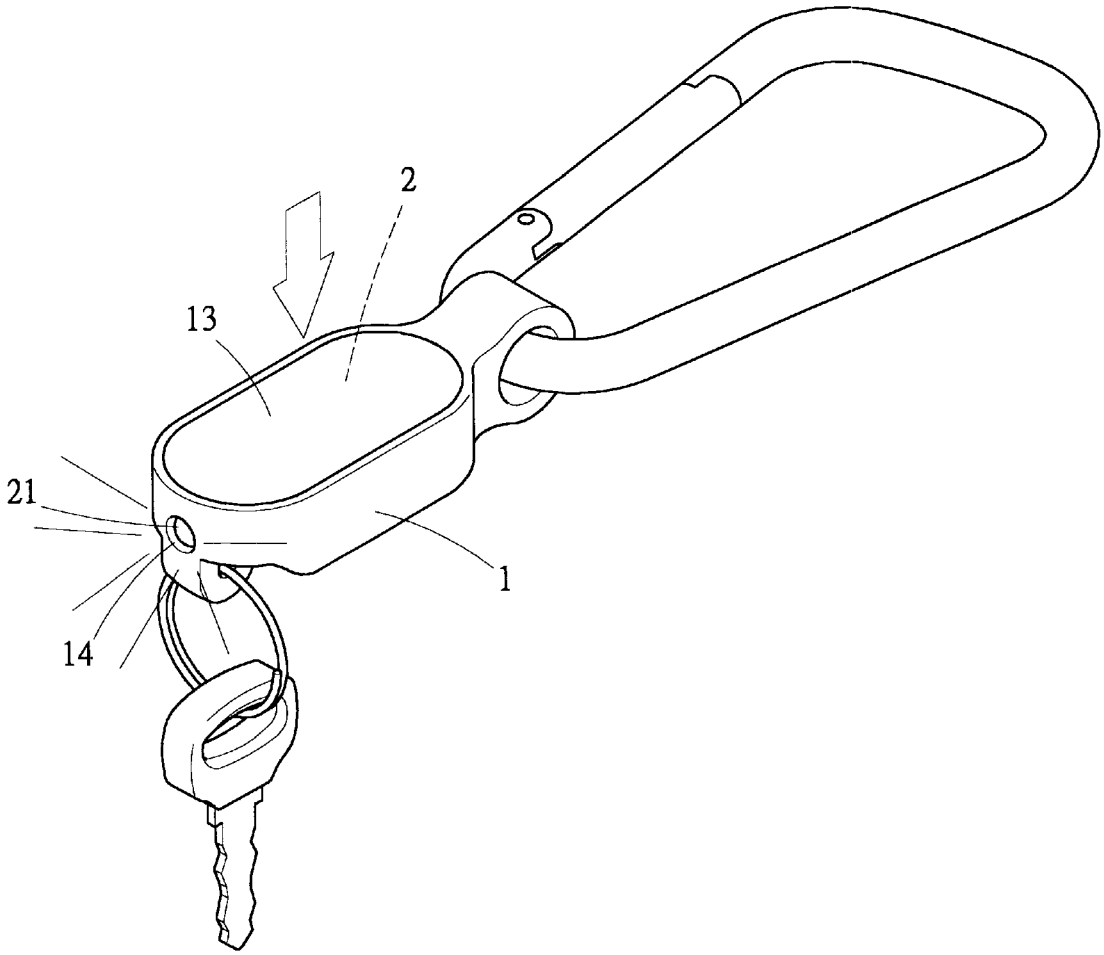
FIG. 3 is a schematic perspective view showing use of the decorative hanging hook of the present invention.

Therefore, the entire structure of the decorative hanging hook can have keys 5 or other ornaments hung on the annular ring 4, and then directly hung on hanging loops "A" on backpacks, clothes or trousers by means of the carabine hook 3, the pressing-closed cover 13 and the connector 1 are provided thereon respectively with a flange 131 and a groove 15 matched with each other to increase tight fitting between the pressing-closed cover 13 and the connector 1. Connecting of the flange 131 with the groove 15 forms a water stopping structure to avoid permeation of rain into the light emitting member 2. Particularly, by the nature that the carabine hook 3 is convenient for operation, a user is convenient in taking the decorative hanging hook off the hanging loop in favor of changing keys or ornaments. Moreover, as shown in FIG. 3, the pressing-closed cover 13 can be pressed to lighten the light emitting diode 21 of the light emitting member 2 to provided a suitable effect of illumination.

The structure of the decorative hanging hook of the present invention takes the connector with a light emitting member as the main body, the connector has on both ends thereof a hole for connecting respectively with a mountaineer carabine hook and an annular ring. Thereby, the entire decorative hanging hook can be directly hung on a backpack or a hanging loop on clothes or trousers with the annular ring thereof having keys or other ornaments. Above all, when being necessary, the light emitting diode on the light emitting member can be lightened by pressing the cover to provide a suitable effect of illumination. Thereby, a preferred structure of the decorative hanging hook is provided; and what I claim as new, industrial utilizable and desire to be secured by Letters Patent of the United States are:

I claim:

1. A structure of a decorative hanging hook, said structure comprises:

a connector being the main body of said decorative hanging hook, in which two holes are provided respectively on the two ends of said connector, a receiving chamber is provided in said main body, a pressing-closed cover is used to close said receiving chamber;

a carabine hook extending into one of said holes on one end of said connector;

an annular ring extending into the other of said holes on another end of said connector;

a light emitting member provided in said receiving chamber of said connector and comprising a light emitting diode and a battery for activating said light emitting diode;

said structure of said decorative hanging hook is adapted for having keys or other ornaments hung on said annular ring and being hung on a hanging loop on a backpack, clothes or trousers with said carabine hook; and said light emitting diode on said light emitting member is selectively activated by pressing on said pressing-closed cover to provide illumination.

2. The structure of a decorative hanging hook as stated in claim 1, wherein, said connector is made of plastic material with tenacity.

3. The structure of a decorative hanging hook as stated in claim 1, wherein, said connector is made of plastic material with tenacity, said main body is provided on one end thereof with a light getting-through hole for projecting light of said light emitting diode.

4. The structure of a decorative hanging hook as stated in claim 1, wherein, said pressing-closed cover and said connector are provided thereon respectively with a flange and a groove matched with each other to increase tight fitting between said pressing-closed cover and said connector, connecting of said flange with said groove forms a water stopping structure to avoid permeation of rain into said light emitting member.

* * * * *